US011592149B1

(12) United States Patent
Cushing

(10) Patent No.: US 11,592,149 B1
(45) Date of Patent: Feb. 28, 2023

(54) HOLIDAY TREE LIGHT SOURCE ASSEMBLY

(71) Applicant: Tracey Cushing, Leander, TX (US)

(72) Inventor: Tracey Cushing, Leander, TX (US)

( * ) Notice: Subject to any disclaimer, the term of this patent is extended or adjusted under 35 U.S.C. 154(b) by 0 days.

(21) Appl. No.: 17/827,868

(22) Filed: May 30, 2022

(51) Int. Cl.

| | |
|---|---|
| ***F21S 4/10*** | (2016.01) |
| ***F21V 23/06*** | (2006.01) |
| ***F21V 21/008*** | (2006.01) |
| ***F21S 9/02*** | (2006.01) |
| ***A47G 33/08*** | (2006.01) |
| ***A47G 33/06*** | (2006.01) |
| ***F21Y 115/10*** | (2016.01) |
| ***F21W 121/04*** | (2006.01) |

(52) U.S. Cl.
CPC ..... *F21S 4/10* (2016.01); *A47G 33/06* (2013.01); *A47G 33/0845* (2013.01); *F21S 9/02* (2013.01); *F21V 21/008* (2013.01); *F21V 23/06* (2013.01); *A47G 2033/0827* (2013.01); *F21W 2121/04* (2013.01); *F21Y 2115/10* (2016.08)

(58) Field of Classification Search
CPC ..... A47G 33/06; A47G 33/0845; A47G 2033/0827; A47G 33/08; A47G 33/10; A41G 1/007; F21S 4/10
See application file for complete search history.

(56) References Cited

U.S. PATENT DOCUMENTS

| | | | | |
|---|---|---|---|---|
| 6,030,670 | A | 2/2000 | Chang | |
| 6,457,839 | B1 * | 10/2002 | Grandoit | A47G 33/06 362/122 |
| 6,588,914 | B1 * | 7/2003 | Tang | F21S 4/10 362/249.19 |
| D491,095 | S | 6/2004 | Gitlin | |
| 8,053,042 | B1 | 11/2011 | Loomis | |
| 8,870,404 | B1 | 10/2014 | Chen | |
| 9,843,147 | B2 | 12/2017 | Leung | |
| 10,091,843 | B1 | 10/2018 | Janning | |
| 10,288,236 | B1 * | 5/2019 | Chen | F21S 4/26 |
| 11,019,692 | B2 | 5/2021 | Leung | |
| 2007/0230174 | A1 * | 10/2007 | Hicks | F21S 13/14 362/249.16 |
| 2008/0158202 | A1 | 7/2008 | Nakamura | |
| 2008/0160224 | A1 * | 7/2008 | Nakamura | A47G 33/0818 428/7 |
| 2012/0275617 | A1 * | 11/2012 | Serve | A47G 33/0818 381/77 |

(Continued)

FOREIGN PATENT DOCUMENTS

| | | |
|---|---|---|
| WO | WO2012158306 | 11/2012 |

*Primary Examiner* — William N Harris

(57) ABSTRACT

A holiday tree light source assembly for inserting a plurality of universal serial bus inputs includes a tree being displayed as a holiday decoration. The tree has a trunk with a plurality of branches protruding off from the trunk. Each of the branches is an electric wire having a plurality of plastic pine leaves. The tree has a bottom base where a power source is positioned proximate to. Furthermore, a plurality of universal serial buses is coupled to the electric wire of each of the branches of the tree. Each of the universal serial buses has a port being a female insert to a universal serial bus input. Each ornament of a plurality of ornaments has a universal serial bus input. The universal serial bus input of each of the ornaments is a male insert to the port of the universal serial bus of the tree.

10 Claims, 3 Drawing Sheets

(56) References Cited

U.S. PATENT DOCUMENTS

| | | | | |
|---|---|---|---|---|
| 2012/0289081 | A1 | 11/2012 | Izzard | |
| 2014/0233234 | A1* | 8/2014 | Bokun | F21V 17/007<br>362/249.06 |

* cited by examiner

HOLIDAY TREE LIGHT SOURCE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tree power source device and more particularly pertains to a new tree power source device for inserting a plurality of universal serial bus inputs.

(2) Description of Related Art Including Information Disclosed Under 37 CFR 1.97 and 1.98

The prior art relates to tree power source devices. The prior art relates to a variety of tree power source devices having a plurality of inputs configured for coupling to light emitting diodes. Known prior art lacks a tree power source device having a plurality of universal serial bus ports configured for coupling to a universal serial bus input of a decorative ornament.

BRIEF SUMMARY OF THE INVENTION

An embodiment of the disclosure meets the needs presented above by generally comprising a tree configured for being displayed as a holiday decoration. The tree has a trunk made of plastic material. A plurality of branches protrudes off from the trunk. Each of the branches is an electric wire having a plurality of plastic pine leaves. The tree has a bottom base, and a power source is positioned proximate to the bottom base of the tree. The power source is a battery. Furthermore, a plurality of universal serial buses is coupled to the electric wire of each of the branches of the tree. Each of the universal serial buses has a port, wherein the port is a female insert to a universal serial bus input. Each ornament of a plurality of ornaments has a universal serial bus input.

The universal serial bus input of each of the ornaments is a male insert to the port of the universal serial bus of the tree.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
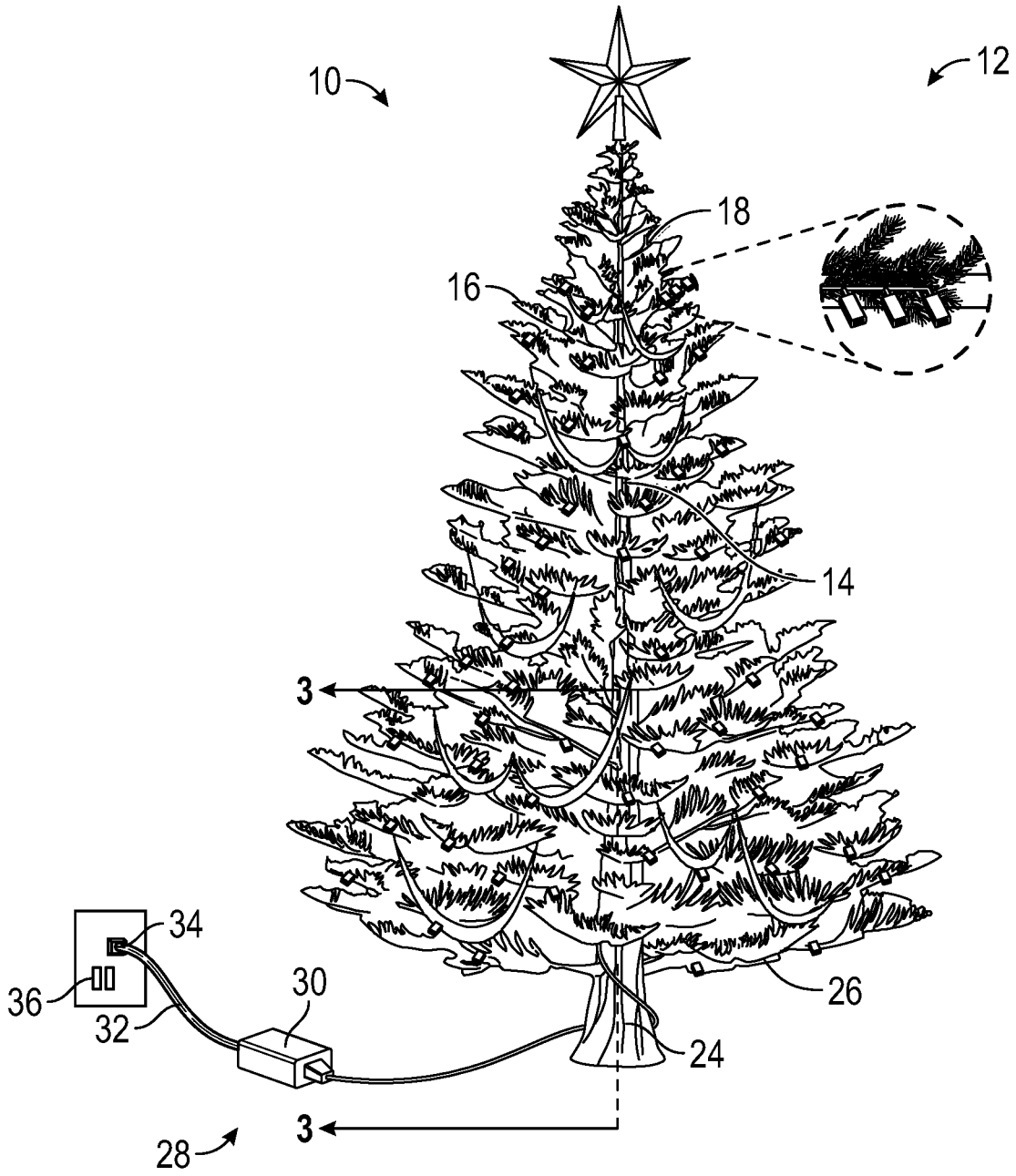
FIG. 1 is a front view of a holiday tree light source assembly according to an embodiment of the disclosure.
Figure 2:
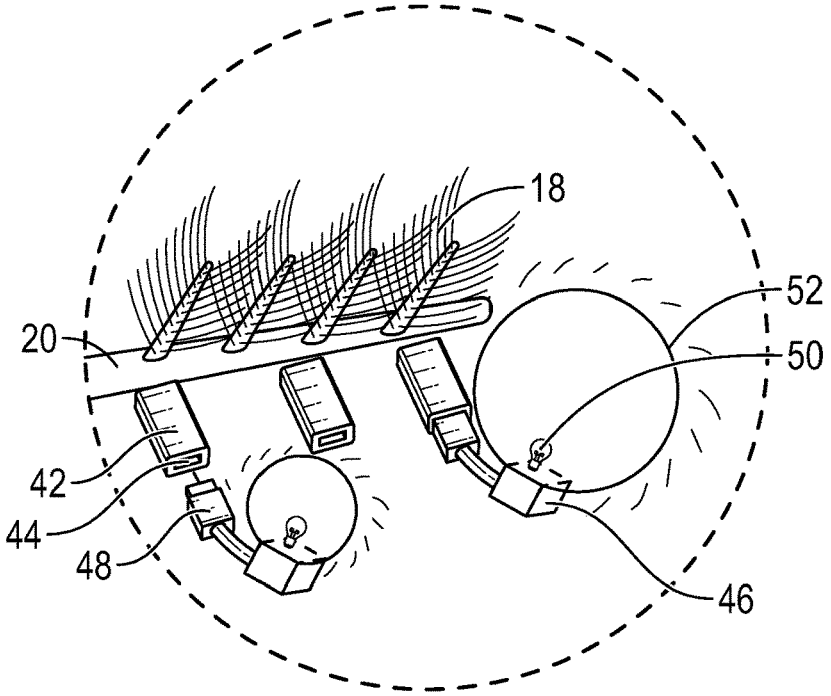
FIG. 2 is a detail view of an embodiment of the disclosure taken from magnification circle of FIG. 1.
Figure 3:
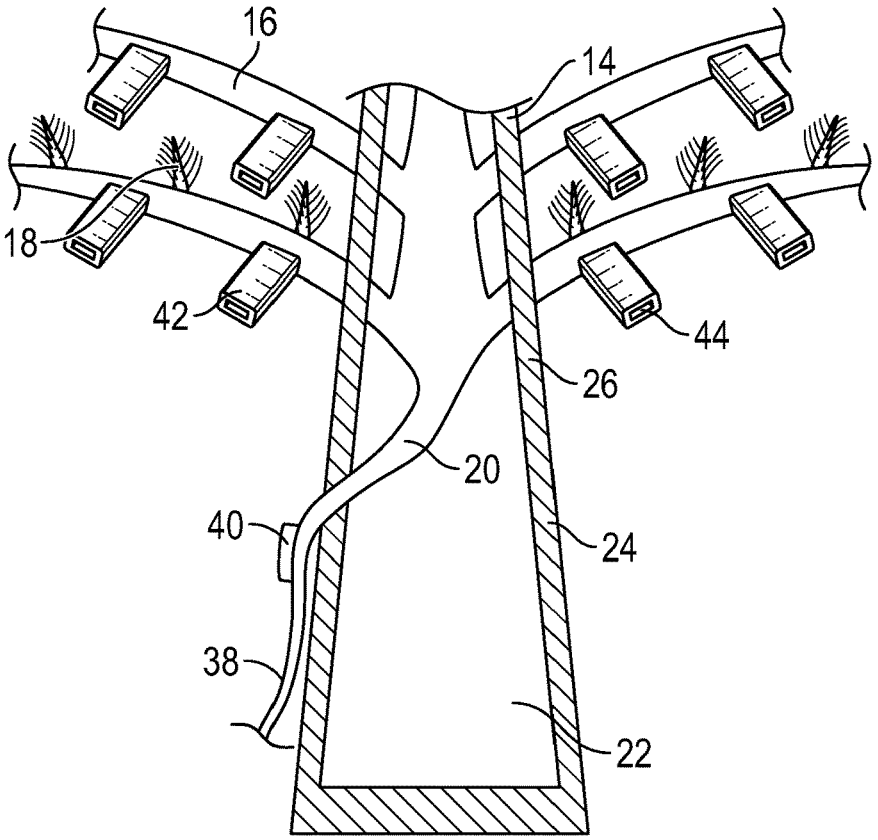
FIG. 3 is a cross-sectional view of an embodiment of the disclosure taken from FIG. 1 of Line 3-3.
Figure 4:
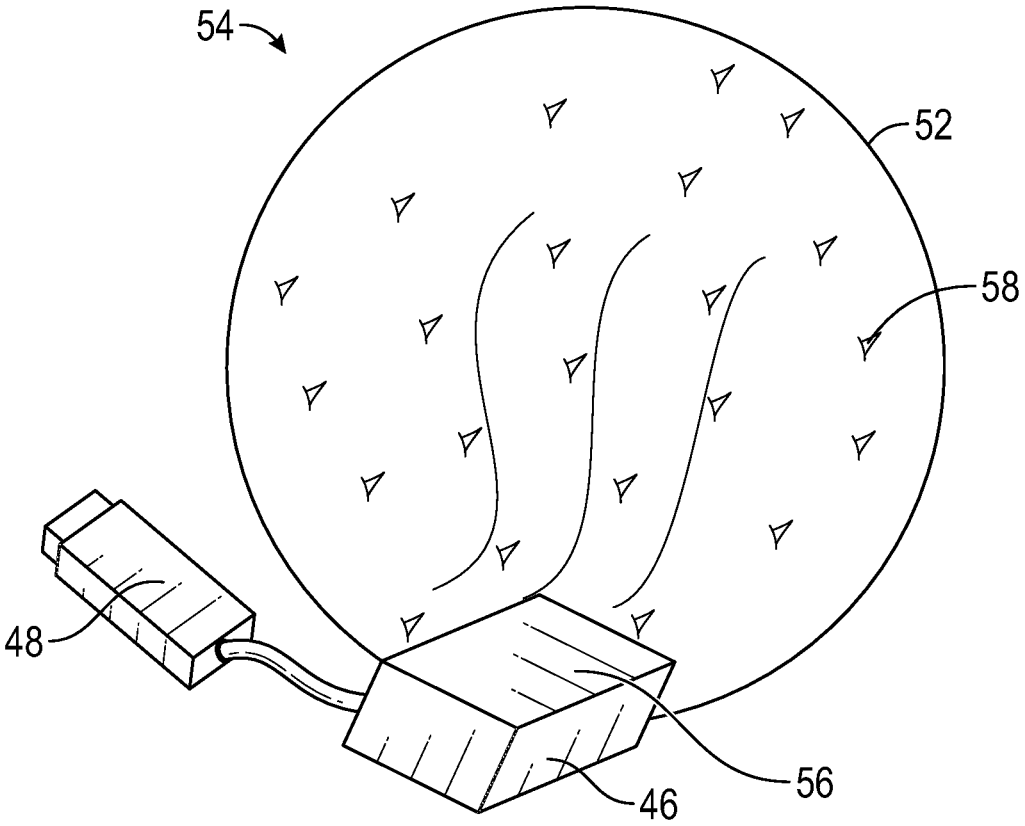
FIG. 4 is an alternate view of an embodiment of the disclosure.

With reference now to the drawings, and in particular to FIGS. 1 through 3 thereof, a new tree power source device embodying the principles and concepts of an embodiment of the disclosure and generally designated by the reference numeral 10 will be described.

As best illustrated in FIGS. 1 through 3, the holiday tree light source assembly 10 generally comprises a tree 12 configured for being displayed as a holiday decoration. The tree 12 is an artificial tree configured for resembling a pine tree. The tree 12 has a trunk 14 made of a plastic material, wherein the plastic material is configured to be lightweight. A plurality of branches 16 protrudes off from the trunk 14. Each of the branches 16 is an electric wire 20 having a plurality of plastic pine leaves 18. The electric wire 20 of each of the branches 16 is configured for being conductivable, wherein the electric wire 20 can carry electricity. The trunk 14 has an interior 22 defining a space for an element to be positioned within. The tree 12 has a triangular cone shape with a bottom base 24. The bottom base 24 is positioned on a bottom surface 26 of the tree 12. The bottom base 24 is configured for lofting the bottom surface 26 of the tree 12 from the ground.

A power source 28 is positioned proximate to the bottom base 24 of the tree 12. The power source 28 is a battery 30, and the battery 30 has a power cord 32. The power cord 32 protrudes out from the battery 30, and the power cord 32 has a male power plug 34. The male power plug 34 of the power cord 32 is configured for inserting into a power outlet 36 wherein accumulating electricity to the battery 30. An electric cord 38 protrudes out from the battery 30 into the interior 22 of the trunk 14 of the tree 12. The electric cord 38 is configured for being a conduit for electricity from the battery 30. Furthermore, a switch 40 is in electric communication with the electric cord 38 from the power source 28. The switch 40 is an actuator for starting and stopping the flow of electricity from the power source 28.

A plurality of universal serial buses 42 is coupled to the electric wire 20 of each of the branches 16 of the tree 12. Each of the universal serial buses 42 has a port 44. The port 44 is a female insert to a universal serial bus input 48. Furthermore, each ornament 46 of a plurality of ornaments 46 has the universal serial bus input 48. The universal serial bus input 48 of each of the ornaments 46 is a male insert to the port 44 of each of the universal serial buses 42 of the tree 12.

Each of the ornaments 46 has a light emitting diode 50. The light emitting diode 50 is in electric communication with the universal serial bus input 48 of each of the ornaments 46. The light emitting diode 50 is positioned in an orb 52, wherein the orb 52 of each of the ornaments 46 is configured for being decorativable. The orb 52 of each of the ornaments 46 is configured for having a holiday decoration such as Christmas.

An alternate embodiment 54 of the plurality of ornaments 46 including each of the ornaments 46 lacking the light emitting diode 50 and has a fan 56 as a replacement. The fan 56 is in electric communication with the universal serial bus input 48 of each of the ornaments 46. The fan 56 is configured for blowing a plurality of fake snow 58 within the orb 52 of each of the ornaments 46, wherein displaying a scene of falling snow within the ornament 46.

In use, the male power plug 34 is inserted into a power outlet 36 to provide electricity to the battery 30. The electric cord 38 from the battery 30 provides power to each of the universal serial buses 42 of each of the branches 16 of the tree 12. The user can insert the universal serial bus input 48 of each of the ornaments 46 into a respective one of the port 44 of each of the universal serial buses 42 of the tree 12. When the switch 40 is engaged with to turn on the electric current, each of the ornaments 46 will emit light through the orb 52. Alternatively, a plurality of ornaments 46 having a fan 56 rather than the light emitting diode 50 can blow the plurality of fake snow 58 within the orb 52 to depict a scene of falling snow.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A holiday tree light source assembly configured for integrating a plurality of universal serial bus ports within a Christmas tree, the holiday tree light source assembly comprising:

a tree configured for being displayed as a holiday decoration, said tree having a trunk made of a plastic material, a plurality of branches protruding off from said trunk, each of said branches being an electric wire having a plurality of plastic pine leaves, said tree having a bottom base;

a power source being positioned proximate to said bottom base of said tree, said power source being a battery;

a plurality of universal serial buses being coupled to said electric wire of each of said branches of said tree, each of said universal serial buses having a port, said port being a female insert to a universal serial bus input; and a plurality of ornaments, each ornament of the plurality of ornaments having a universal serial bus input, said universal serial bus input of each of said ornaments being a male insert inserted into said port of said universal serial bus of said tree.

2. The holiday tree light source assembly of claim 1, further comprising said trunk having an interior defining a space for an element to be positioned within, said tree having a triangular cone shape.

3. The holiday tree light source assembly of claim 2, further comprising said bottom base being positioned on a bottom surface of said tree, said bottom base being configured for lofting said bottom surface of said tree from the ground.

4. The holiday tree light source assembly of claim 3, further comprising said battery having a power cord, said power cord protruding out from said battery, said power cord having a male power plug, said male power plug of said power cord being configured for being inserted into a power outlet for accumulating electricity to said battery.

5. The holiday tree light source assembly of claim 4, further comprising an electric cord protruding out from said battery into said interior of said trunk of said tree, said electric cord being configured for being a conduit for electricity from said battery.

6. The holiday tree light source assembly of claim 1, further comprising a switch being in electric communication with an electric cord from said power source, said switch being an actuator for starting and stopping the flow of electricity from said power source.

7. The holiday tree light source assembly of claim 1, further comprising each of said ornaments having a light emitting diode, said light emitting diode being positioned in an orb, said orb of each of said ornaments being configured for being decorative.

8. The holiday tree light source assembly of claim 7, further comprising said light emitting diode being in electric communication with said universal serial bus input of each of said ornaments.

9. The holiday tree light source assembly of claim 8, further comprising an alternate embodiment of said plurality of ornaments including each of said ornaments lacking said light emitting diode and having a fan, said fan being in electric communication with said universal serial bus input, said fan being configured for blowing a plurality of fake snow within said orb of each of said ornaments.

10. A holiday tree light source assembly configured for integrating a plurality of universal serial bus ports within a Christmas tree, the holiday tree light source assembly comprising:

a tree configured for being displayed as a holiday decoration, said tree being an artificial tree, said artificial tree being configured for resembling a pine tree, said tree having a trunk made of a plastic material, a plurality of branches protruding off from said trunk, each of said branches being an electric wire having a plurality of plastic pine leaves, said electric wire of each of said branches being configured for being conductive, said trunk having an interior defining a space for an element to be positioned within, said tree having a triangular cone shape, said tree having a bottom base, said bottom base being positioned on a bottom surface of said tree, said bottom base being configured for lofting said bottom surface of said tree from the ground;

a power source being positioned proximate to said bottom base of said tree, said power source being a battery, said battery having a power cord, said power cord protruding out from said battery, said power cord having a male power plug, said male power plug of said power cord being configured for being inserted into a power outlet for accumulating electricity to said battery, an electric cord protruding out from said battery into said interior of said trunk of said tree, said electric cord being configured for being a conduit for electricity from said battery;

a switch being in electric communication with said electric cord from said power source, said switch being an actuator for starting and stopping the flow of electricity from said power source;

a plurality of universal serial buses being coupled to said electric wire of each of said branches of said tree, each of said universal serial buses having a port, said port being a female insert to a universal serial bus input; and a plurality of ornaments, each of said ornaments having a light emitting diode, said light emitting diode being positioned in an orb, said orb of each of said ornaments being configured for being decorative, each of said ornaments having a universal serial bus input, said light emitting diode being in electric communication with said universal serial bus input of each of said ornaments, said universal serial bus input of each of said ornaments being a male insert to said port of said universal serial bus of said tree; and an alternate embodiment of said plurality of ornaments including each of said ornaments lacking said light emitting diode and having a fan, said fan being in electric communication with said universal serial bus input, said fan being configured for blowing a plurality of fake snow within said orb of each of said ornaments.

* * * * *